US009676115B2

(12) United States Patent
Takayanagi et al.

(10) Patent No.: US 9,676,115 B2
(45) Date of Patent: Jun. 13, 2017

(54) GUIDE BAR FASTENING DEVICE FOR CHAIN SAW

(71) Applicant: MAKITA CORPORATION, Aichi (JP)

(72) Inventors: Yoshiaki Takayanagi, Tokyo (JP); Masashi Sugiyama, Tokyo (JP)

(73) Assignee: MAKITA CORPORATION, Aichi (JP)

( * ) Notice: Subject to any disclaimer, the term of this patent is extended or adjusted under 35 U.S.C. 154(b) by 353 days.

(21) Appl. No.: 14/220,271

(22) Filed: Mar. 20, 2014

(65) Prior Publication Data

US 2014/0290075 A1 Oct. 2, 2014

(30) Foreign Application Priority Data

Mar. 29, 2013 (JP) ..... 2013-074904

(51) Int. Cl.
*B27B 17/14* (2006.01)

(52) U.S. Cl.
CPC ..... *B27B 17/14* (2013.01)

(58) Field of Classification Search
CPC ..... B27B 17/14
USPC ..... 30/381–387
See application file for complete search history.

(56) References Cited

U.S. PATENT DOCUMENTS 5,396,705 A * 3/1995 Leini ..... B27B 17/02 30/386
5,522,143 A * 6/1996 Schliemann ..... B27B 17/14 30/383
6,004,064 A * 12/1999 Franz ..... B62K 25/02 301/124.2
6,560,879 B2 * 5/2003 Franke ..... B27B 17/14 30/383
6,877,233 B1 * 4/2005 Franke ..... B27B 17/14 30/383

(Continued)

FOREIGN PATENT DOCUMENTS

DE 202006019362 11/2007
DE 102014004061 A1 * 10/2014

(Continued)

OTHER PUBLICATIONS

German Official Action for Appl. No. DE 102014004062.3, along with an English-language translation thereof.

(Continued)

*Primary Examiner* — Jason Daniel Prone
(74) *Attorney, Agent, or Firm* — Greenblum & Bernstein, P.L.C.

(57) ABSTRACT

To provide an operation lever including a first lever that has a base end portion swingably supported to a peripheral portion of a nut member for fastening a guide bar in a chain saw, and a second lever that is engaged with the first lever in a manner slidable in an axial direction. The operation lever can be placed in a receiving portion of the nut member with an axial length thereof shortened, and can be manipulated to rotate the nut member by being gripped on an outer end portion of the second lever in a state in which the operation lever is lifted out from the receiving portion and the axial length is lengthened. Thus, a sufficient fastening force for the guide bar can be obtained, and operability can be improved.

10 Claims, 9 Drawing Sheets

(56) References Cited

U.S. PATENT DOCUMENTS

| | | | | |
|---|---|---|---|---|
| 7,107,689 | B2 * | 9/2006 | Keeton | B27B 17/14 30/383 |
| 7,434,502 | B2 * | 10/2008 | Keeton | B27B 17/14 30/386 |
| 7,600,323 | B2 * | 10/2009 | Sugishita | B27B 17/14 30/386 |
| 7,676,934 | B2 * | 3/2010 | Liao | B27B 17/14 30/383 |
| 7,743,513 | B1 * | 6/2010 | Fisher | B27B 17/14 30/383 |
| 8,365,420 | B2 * | 2/2013 | Pellenc | B27B 17/14 30/386 |
| 9,573,208 | B2 * | 2/2017 | Takayanagi | B23D 57/023 30/381 |
| 2010/0146801 | A1 | 6/2010 | Pellene | |
| 2011/0314682 | A1 * | 12/2011 | Maag | B27B 17/14 30/386 |
| 2014/0047722 | A1 * | 2/2014 | Onose | B27B 17/00 30/383 |
| 2014/0250702 | A1 * | 9/2014 | Zimmermann | B27B 17/14 30/386 |
| 2014/0290074 | A1 * | 10/2014 | Takayanagi | B23D 57/023 30/382 |
| 2014/0290076 | A1 * | 10/2014 | Takayanagi | B27B 17/14 30/386 |
| 2015/0290830 | A1 * | 10/2015 | Zieger | B27B 17/02 30/383 |

FOREIGN PATENT DOCUMENTS

| | | | | |
|---|---|---|---|---|
| EP | 2433754 | | 3/2012 | |
| JP | 2006-103301 | | 4/2006 | |
| JP | 2010-519058 | | 6/2010 | |
| JP | DE 102014004063 | A1 * | 10/2014 | B23D 57/023 |
| JP | DE 102014004062 | A1 * | 7/2015 | B27B 17/14 |
| WO | 2004/103657 | | 12/2004 | |
| WO | 2008/122716 | | 10/2008 | |
| WO | 2012/144942 | | 10/2012 | |

OTHER PUBLICATIONS

Japanese Office Action for JP App. No. 2013-074904 mailed on Jul. 26, 2016, along with English-language translation thereof.

* cited by examiner

FIG.
3A
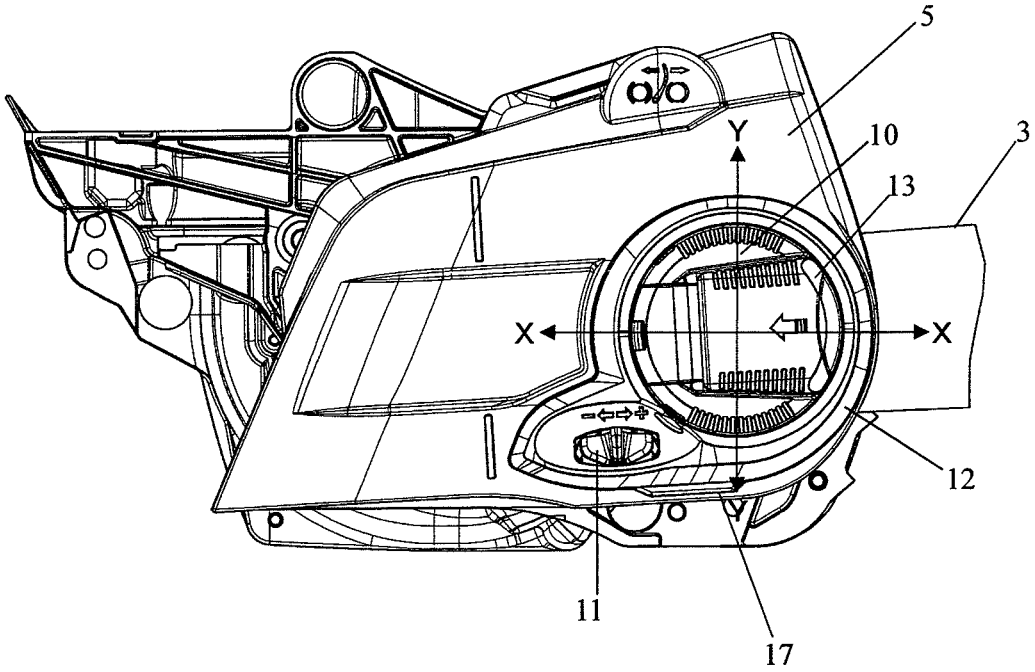

FIG.
4C
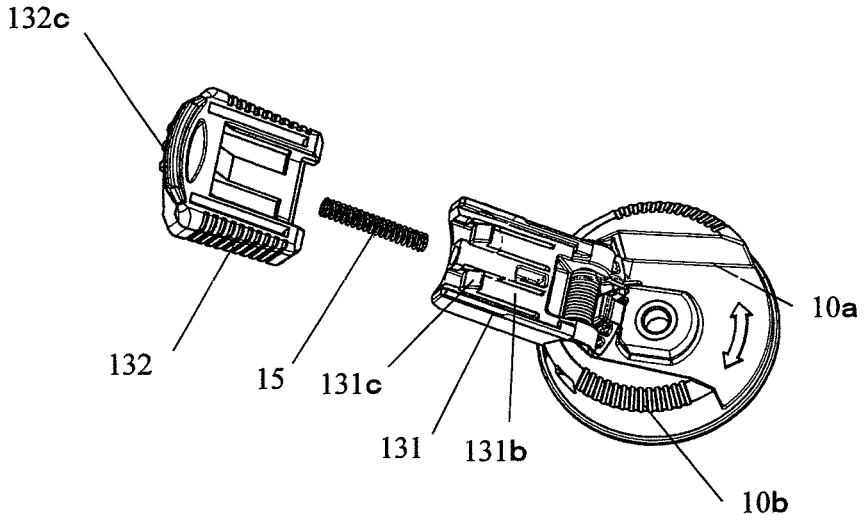

GUIDE BAR FASTENING DEVICE FOR CHAIN SAW

BACKGROUND OF THE INVENTION

1. Field of the Invention

The present invention relates to a device, for use in a chain saw, the device fastens a guide bar that supports a saw chain on a peripheral portion thereof to a chain saw body.

2. Description of Related Art

A chain saw is configured to secure a guide bar, which supports a saw chain on a peripheral portion of the guide bar, to a chain saw body with a bolt member and a nut.

Japanese Laid-open Patent Application Publication No. 2006-103301 discloses a guide bar fastening device, in which a guide bar is manually fastened (and unfastened) by rotating a semicircular lever, that is supported to a semicircular rotating knob in a diametral direction thereof, the knob being integrally secured on a nut fastening the guide bar, to thereby rotate the nut.

However, in such a guide bar fastening mechanism, a length of the lever is short because the length is limited by the size of the rotating knob, and accordingly, it might be difficult to achieve a sufficient fastening force. It might be difficult to enlarge the rotating knob because the size of the knob is limited by the size of a chain cover.

SUMMARY OF THE INVENTION

The present invention is provided in order to solve the problems in the conventional guide bar fastening device, and thus, an object of the present invention is to provide a guide bar fastening device for a chain saw, that can achieve a greater fastening force applied to the guide bar by a less operating force while maintaining a compactness, and can achieve improved operability.

In order to achieve the above object, a guide bar fastening device for a chain saw according to an aspect of the present invention includes:

a guide bar that supports a saw chain on a peripheral portion thereof, one end portion of the guide bar being retained between a chain saw body and a chain cover;

a bolt member that is secured to the chain saw body and disposed to penetrate through the one end portion of the guide bar and the chain cover;

a circular nut member that fastens the guide bar by screwing a central portion of the nut member on a screw portion of the bolt member, the screw portion protruding toward an outside of the chain cover; and an operation lever that includes: a first lever that extends in a diametral direction of the nut member, and that has a base end portion that is supported to a peripheral portion of the nut member, so that the first lever is swingable on a plane perpendicular to a rotation plane of the nut member; and a second lever that engages with the first lever in a manner slidable in an axial direction, in which the operation lever is capable of being shortened and lengthened in axial length by a sliding movement of the second lever, in which, in a state in which the axial length is shortened, the operation lever is placed in a receiving portion formed along a radial direction of the nut member, whereas in a state in which the operation lever is lifted out from the receiving portion and the axial length is lengthened outward in the radial direction of the nut member, the operation lever is manipulated to rotate the nut member by being gripped on an outer end portion of the second lever.

According to the aspect of the present invention, the guide bar can be fastened and unfastened by gripping the end portion of the second lever in the state in which the operation lever is lifted out from the receiving portion of the nut member and the axial length of the operation lever is lengthened outward in the radial direction, and then by rotating the nut member. Then, the operation lever can be placed in the receiving portion of the nut member in the state in which the axial length is shortened.

In this case, since the second lever is slidably engaged with the first lever, the axial length of the operation lever in the state in which the operation lever is lengthened outward in the radial direction can be increased.

Thus, while maintaining the compactness, a sufficient rotating torque of the nut, that is, sufficient fastening force for the guide bar, can be obtained by the less operating force, and the operability can also be improved.

Other objects and features of aspects of the present invention will be understood from the following description with reference to the accompanying drawings.

BRIEF DESCRIPTION OF THE DRAWINGS

FIG. 3A is a front view illustrating the main part of the chain saw.

FIG. 4C is an exploded perspective view of the FIG. 4A;

DESCRIPTION OF THE PREFERRED EMBODIMENTS

Hereunder, an embodiment of the present invention will be described with reference to the accompanying drawings.

Figure 1:
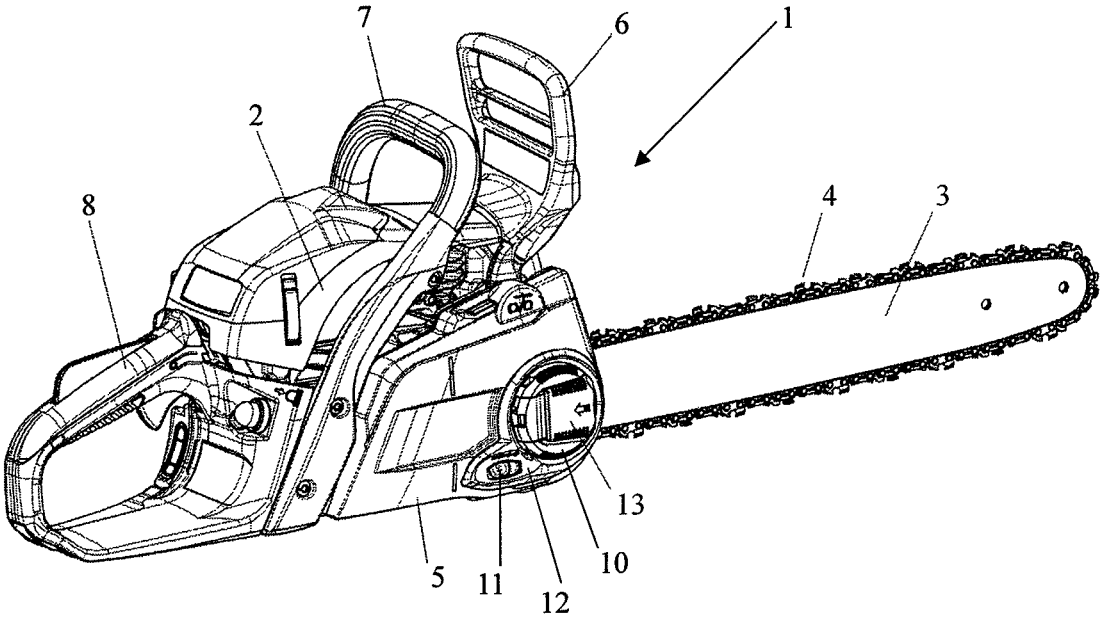
FIG. 1 is a perspective view illustrating an overall configuration of a chain saw according to an embodiment of the present invention.

FIG. 1 illustrates an overall configuration of a chain saw according to an embodiment of the present invention, and FIGS. 2 to 6 illustrate a configuration of each component.

In a chain saw 1, a guide bar 3 extending frontward is attached to a chain saw body (hereinbelow, referred to as "body") 2. On a peripheral portion of the guide bar 3, a saw chain 4 is supported.

The saw chain 4 engages with a sprocket (not illustrated) that is driven to be rotated by a motor, such as an engine or an electric motor, in the body 2, to be rotated around the sprocket and the peripheral portion of the guide bar 3, one end portion of which adjoins the sprocket.

An area around the sprocket, a part of the guide bar 3, and the like, is covered by a chain cover 5. The chain cover 5 is attached to the body 2.

At the front part of the body 2, a front guard 6 that is integrated with the chain cover 5 is attached. Behind the front guard 6, a front handle 7 and a rear handle 8 are attached.

Figure 2:
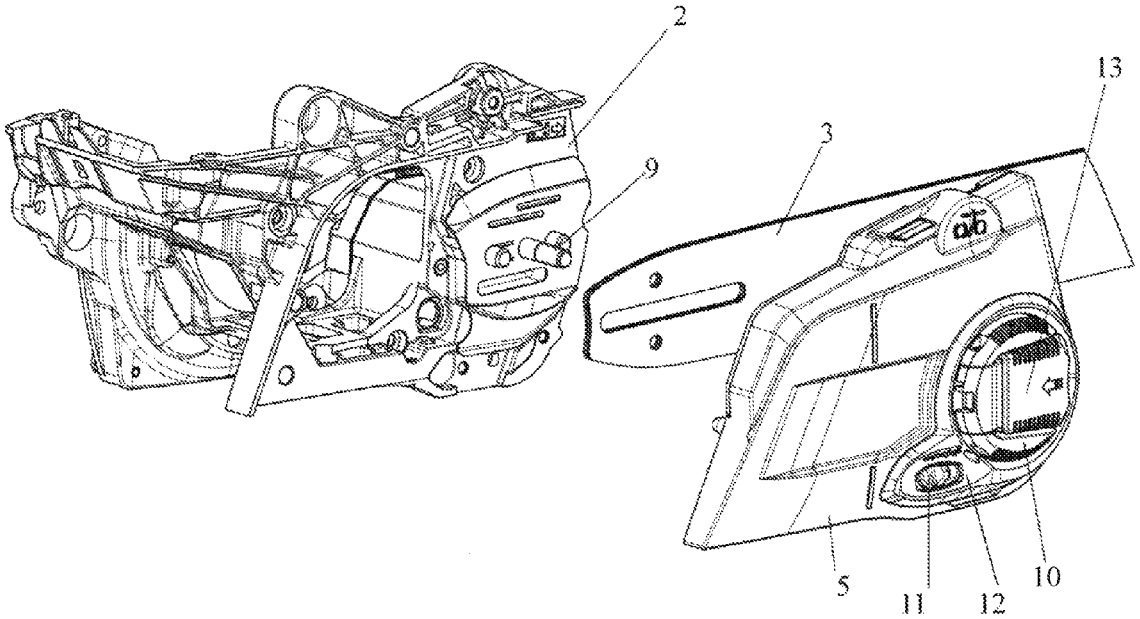
FIG. 2 is an exploded perspective view illustrating a body, a guide bar and a chain cover, which constitute the chain saw.
Figure 3B:
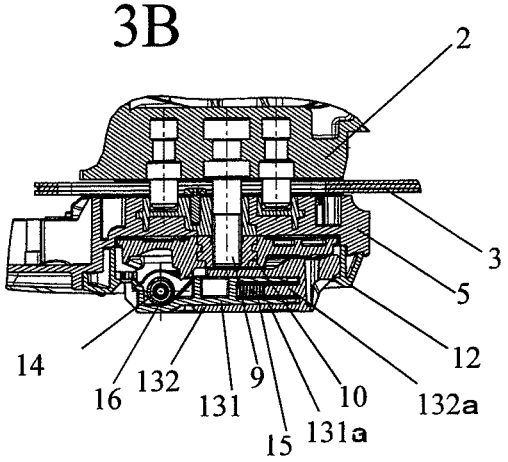
FIG. 3B is a cross-sectional view taken along with a line X-X of FIG. 3A.
Figure 3C:
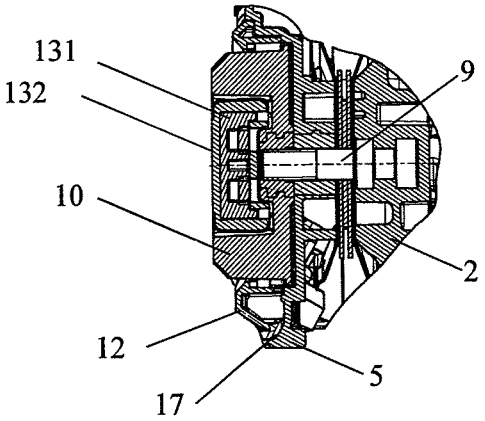
FIG. 3C is a cross-sectional view taken along with a line Y-Y of FIG. 3A.
Figure 4A:
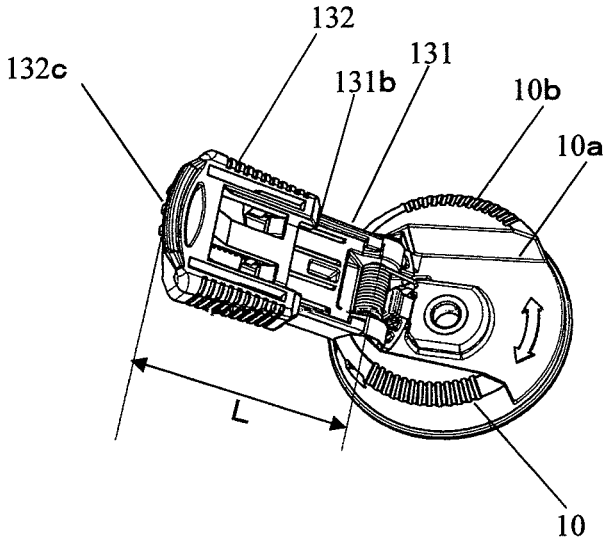
FIG. 4A is a perspective view illustrating a nut member and an operation lever, which constitute the chain saw, in an opened state of the operation lever.
Figure 4B:
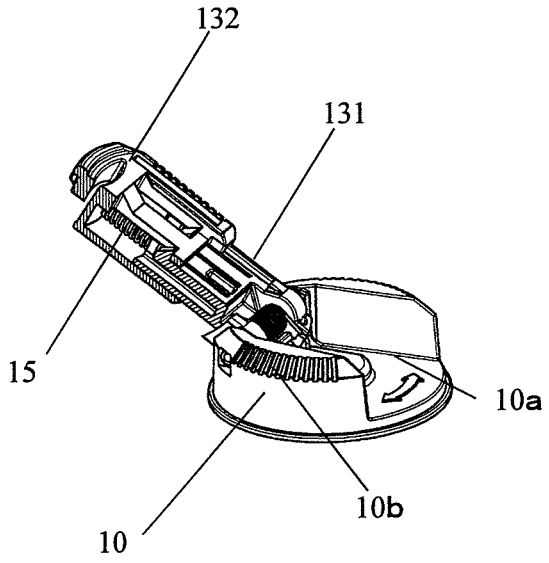
FIG. 4B is a perspective view illustrating a cross-section of the operation lever of the FIG. 4A.

As illustrated in FIG. 2 (exploded view) and FIGS. 3A-3C, the guide bar 3 is retained between the body 2 and the chain cover 5 at the one end portion of the guide bar 3 adjoining the sprocket. To fasten the guide bar 3, a bolt member (stud bolt) 9 and a nut member 10 are provided.

A base end portion of the bolt member 9 is secured to the body 2. A central portion of the circular nut member 10 is screwed on a screw portion of the bolt member 9, the screw portion protruding toward an outside of the chain cover 5, to fasten the guide bar 3.

To the chain cover 5, an adjusting unit cover 12, which covers the nut member 10, a tension adjusting member 11 of the saw chain 4, and the like, to prevent the nut member 10 from falling out, is attached by being fastened with a screw.

As illustrated in FIGS. 4A-4C and 5A-5D, on the nut member 10, a receiving portion 10*a* is formed along a diametral direction. An operation lever 13 that is manipulated to rotate the nut member 10 is attached in a manner that the operation lever 13 swings from a closed position in which the operation lever 13 is placed in the receiving portion 10*a* of the nut member 10 (see, FIG. 5C, etc.) to an opened position for rotating the nut member 10 (see, FIGS. 5A, 5B, etc.). Hereunder, the operation lever 13 will be described in detail.

The operation lever 13 extends in the diametral direction of the nut member 10, and as illustrated in FIG. 3B, a base end portion of the operation lever 13 is supported on a peripheral portion of the nut member 10 via a hinge 14. The operation lever 13 includes a first lever 131 that is swingable on a plane perpendicular to a rotation plane of the nut member 10, and a second lever 132 that engages with the first lever 131 in a manner slidable in an axial direction. By sliding the second lever 132, the axial length of the operation lever 13 can be shortened and lengthened.

As illustrated in FIGS. 4A-4C and 5A-5D, the second lever 132 engages with the first lever 131, covering the outside of the first lever 131, and the second lever 132 is formed in a shape widening toward an outer end thereof in a direction away from the first lever 131.

Between the second lever 132 and the first lever 131, a coil spring 15 is disposed so that the coil spring 15 urges the second lever 132 in a direction away from the first lever 131, that is, in a direction increasing the axial length of the operation lever 13 (lengthening direction).

Figure 5A:
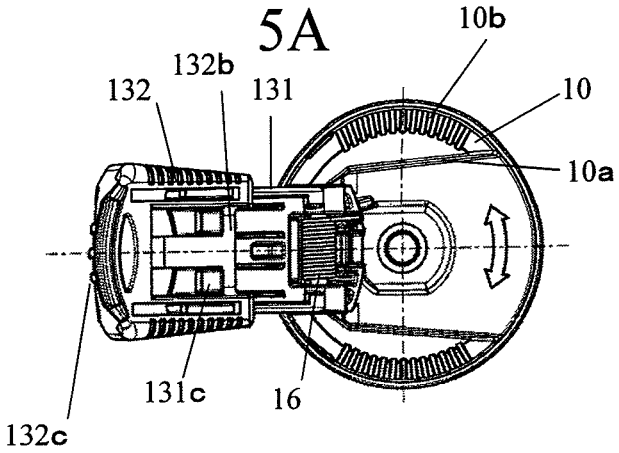
FIG. 5A is a front view illustrating the nut member and the operation lever in the opened state of the operation lever.
Figure 5B:
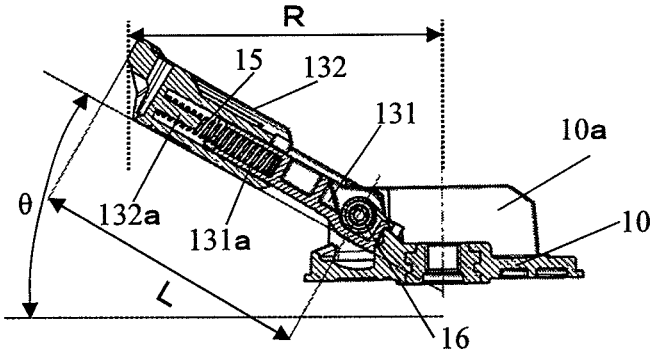
FIG. 5B is a longitudinal cross-sectional view of FIG. 5A.
Figure 5C:
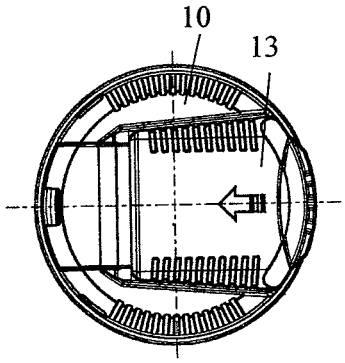
FIG. 5C is a front view illustrating the nut member and the operation lever in a closed state of the operation lever.
Figure 5D:
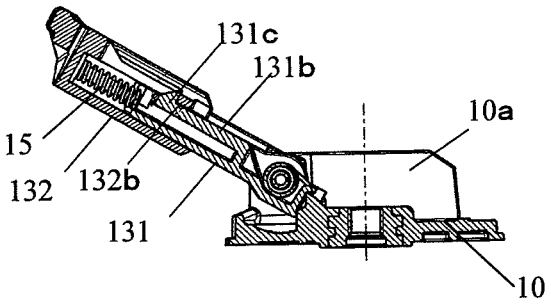
FIG. 5D is another longitudinal cross-sectional view of FIG. 5A different from that in FIG. 5B.
Figure 6:
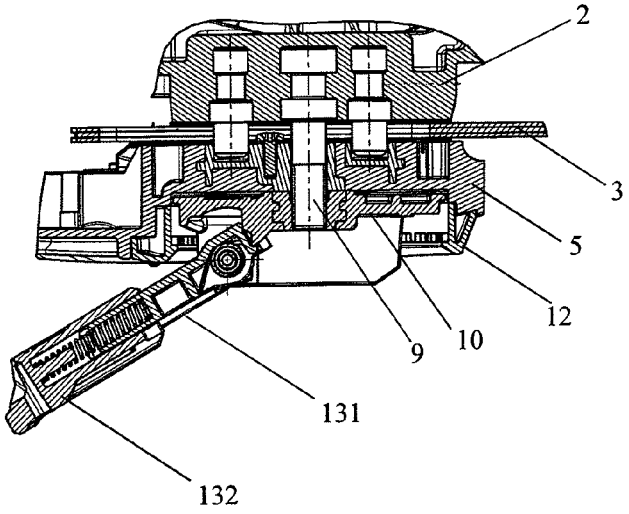
FIG. 6 is a cross-sectional view illustrating a fastening portion of the guide bar.

Specifically, as illustrated in FIG. 5B, etc., a protruding rod 132*a* is formed to extend toward the first lever 131 from an inner surface of an end wall of the second lever 132. In the first lever 131, a cylindrical portion 131*a* configured so that the protruding rod 132*a* is capable of being put in and out the cylindrical portion 131*a* is formed. In addition, in an annular gap between the protruding rod 132*a* and the cylindrical portion 131*a*, the coil spring 15 is inserted and attached in a compressed state.

On both sides of the cylindrical portion 131*a* of the first lever 131, a pair of stopper arms 131*b* that extends in the axial direction from the base end portion is formed. On the tip portion of the stopper arm 131*b*, a claw 131*c* that protrudes in a swinging direction of the lever on a closing direction side is formed.

On the other hand, on the second lever 132, a lock portion 132*b* that locks the claw 131*c* of the stopper arm 131*b* is formed. Since the claw 131*c* can be locked in the lock portion 132*b* in a state in which the axial length of the operation lever 13 is lengthened to a maximum, the second lever 132 can be prevented from being removed from the first lever 131 (see, FIG. 5D).

The stopper arm 131*b* is made of resin and is flexible. When performing maintenance, by pushing the claw 131*c* to unlock the claw 131*c* from the lock portion 132*b*, the second lever 132 can be removed from the first lever 131.

The operation lever 13 is urged by a torsion coil spring 16, which is disposed on the outside of the hinge 14, in the closing direction to be placed in the receiving portion 10*a* of the nut member 10.

As illustrated in FIGS. 4A-4C and 5A-5D, on an arc-shaped outer end surface of the second lever 132, at least one (three in the figures) protrusion 132*c* protruding in the radial direction is formed.

Figure 7:
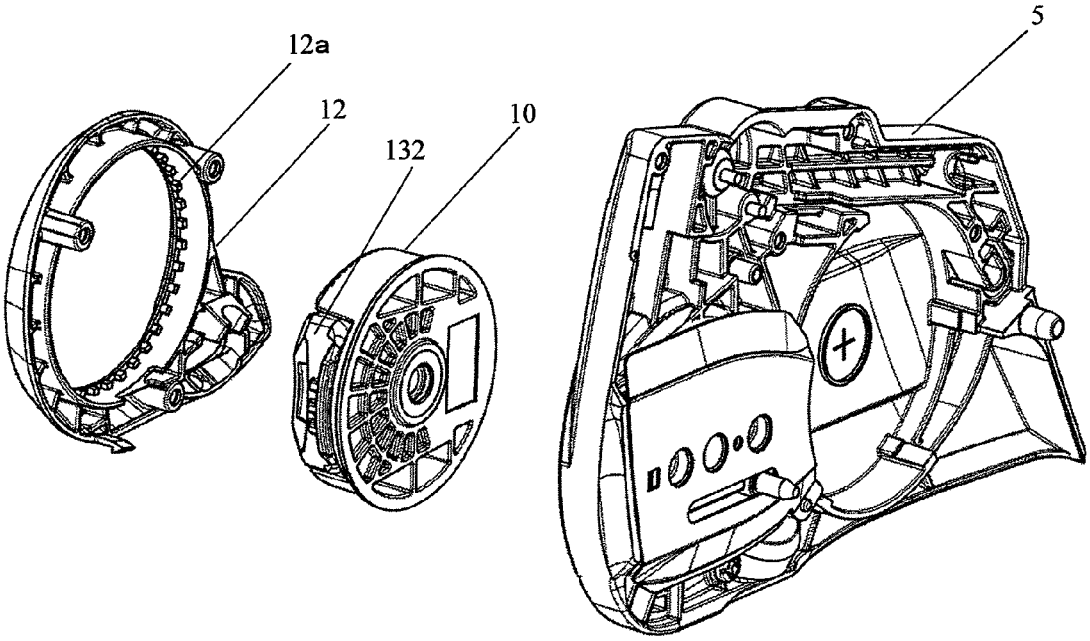
FIG. 7 is an exploded perspective view illustrating an adjusting unit cover, the nut member and the chain cover, which constitute the chain saw, seen from the rear side.

On the other hand, on an inner peripheral wall of the adjusting unit cover 12, which faces an outer peripheral wall of the nut member 10, a plurality of grooves 12*a*, which is engageable with the protrusion 132*c* at any lever rotational angle position, is arranged all around the inner peripheral wall at even intervals, as illustrated in FIG. 7.

In the lever mechanism having such a configuration, normally, the nut member 10 is screwed on the bolt member 9, and the guide bar 3 retained between the chain cover 5 and the body 2 is fastened by a fastening force greater than that predetermined and retained in a stable state.

The tip portion of the second lever 132 is compressed in the adjusting unit cover 12 with the coil spring 15 compressed, and the protrusion 132*c* is engaged with the grooves 12*a* of the adjusting unit cover 12, so that the nut member 10 is retained and prevented from being rotated.

Hereunder, a series of processes, which begins from this state and including a process of unfastening the guide bar 3, a process of adjusting a longitudinal location of the guide bar 3 to adjust a tension of the saw chain 4, and a process of fastening the guide bar 3 again, will be described.

To unfasten the guide bar 3, the outer end portion of the second lever 132, that protrudes outward from the adjusting unit cover 12, is pushed in a direction to shorten the axial direction of the operation lever 13, to disengage the protrusion 132*c* from the grooves 12*a*, and then the operation lever 13 is moved in the opening direction thereof, resisting a biasing force of the torsion coil spring 16, to free the operation lever 13 from the receiving portion 10*a* of the nut member 10.

As a result, a biasing force of the coil spring 15 causes the second lever 132 to slide away from the first lever 131, so that the operation lever 13 is lengthened to a maximum axial length.

Moreover, by swinging the operation lever 13 (first lever 131 and second lever 132) to rotate about the hinge 14, resisting the biasing force of the torsion coil spring 16, the operation lever 13 is opened outward in the radial direction of the nut member 10.

In this case, as illustrated in FIG. 5B, a rotation stopper mechanism (not illustrated), that is disposed on the first lever 131 and the nut member 10 around the hinge 14, restricts and maintains a maximum opening angle θ to an angle defined by a line extending obliquely from the top surface of the nut member 10 away from the chain cover 5.

In this state, by gripping the widened end portion of the second lever 132, and by rotating the nut member 10 in a loosening direction (for example, in a counterclockwise direction) by a predetermined amount or more, the nut member 10 is loosened, and the guide bar 3 is unfastened.

By rotating the tension adjusting member 11 to move the disengaged guide bar 3 in the longitudinal direction via a screw mechanism (not illustrated), or the like, the tension of the saw chain 4 is adjusted.

After adjusting the tension of the saw chain 4, the guide bar 3 is fastened as follows.

By gripping the end portion of the second lever 132, which has been opened as described above, the nut member 10 is rotated about the axis in a fastening direction of the guide bar 3 (for example, in a clockwise direction). This causes the nut member 10 to be screwed on the bolt member 9, and accordingly, the fastening force applied to the guide bar 3 retained between the chain cover 5 and the body 2 increases.

When it is determined that the sufficient fastening force has been applied to the guide bar 3, by making a stopper function of the rotation stopper mechanism to be cancelled, the operation lever 13 is swung in the closing direction. At the same time, by pushing the second lever 132 inward, the coil spring 15 is compressed and the axial length of the operation lever 13 is shortened. Then, the outer end portion of the second lever 132 is placed inside the adjusting unit cover 12, and the second lever 132 is placed in the receiving portion 10*a*, and finally, the second lever 132 is released from the hand.

Thus, when the operation lever 13 is placed in the receiving portion 10*a* of the nut member 10, the protrusion 132*c* of the second lever 132 is engaged with the grooves 12*a* of the adjusting unit cover 12 at the same time, and accordingly, the nut member 10 and the operation lever 13 can be prevented from being rotated.

In addition, when adjusting the tension of the saw chain 4, if the operation lever 13 is lengthened with the nut member 10 loosened, the operation lever 13 may be unstable. Thus, as described above, by shortening the operation lever 13 and by placing it in the receiving portion 10*a* to prevent from being rotated, the operation lever 13 can be kept in a stable state, resulted in improved workability of the tension adjustment.

As described above, according to the present embodiment, since the operation lever 13 has the structure capable of changing the axial length of the operation lever 13, the axial length of the operation lever 13 can be lengthened as much as possible even under the condition in which the size (diameter) of the nut member 10 is limited due to the smaller chain saw. For example, as illustrated in FIG. 5B, a maximum axial length L of the operation lever 13 can be no less than the diameter of the nut member 10, and furthermore, a turning radius R from the rotation axis of the nut member 10 to the outer end of the operation lever 13 can be no less than the diameter of the nut member 10.

Thus, an operating force (input) of the operation lever 13 can be converted to a greater rotating torque of the nut member 10, to increase the fastening (unfastening) force for the guide bar 3, resulted in the improved operability.

Furthermore, when the operation lever 13 is not used, the operation lever 13 can be compactly placed in the receiving portion 10*a* of the nut member 10.

Still further, since the second lever 132 is configured to cover the outside of the first lever 131, the second lever 132 can be formed to be wider than a reverse case (i.e., a case in which the inner lever is configured to cover the outside of the outer lever). Moreover, since the second lever 132 is formed so that the width thereof is increases outwardly, it can be easier to grip the second lever 132, resulting in the improved operability.

Furthermore, when the operation lever 13 is lengthened, the biasing force of the coil spring 15 can maintain the operation lever 13 to the maximum axial length L, and in addition, can enable the operation lever 13 to be manipulated in a state in which the operation lever 13 is stably maintained to the maximum opening angle θ, resulting in the improved operability.

Still further, when the operation lever 13 is placed in the receiving portion 10*a*, since the coil spring 15 that urges the second lever 132 in the axial-length increasing direction is provided, the protrusion 132*c* is urged in a direction in which the protrusion 132*c* is engaged with the grooves 12*a*, and accordingly, this can maintain the detent function.

However, without providing the protrusion 132*c* and the grooves 12*a*, the detent function may be achieved by means of a friction force by only bringing the outer end surface of the second lever 132 into contact with the inner peripheral surface of the adjusting unit cover 12 by the biasing force of the coil spring 15.

Furthermore, since the maximum opening angle θ of the operation lever 13 is restricted to the angle defined by a line extending obliquely from the top surface of the nut member 10 away from the chain cover 5, it can be easy to insert a hand between the operation lever 13 and the chain cover 5 when manipulating the operation lever 13, and a hand can be prevented from touching the saw chain 4.

As illustrated in FIGS. 3A and 3C, regarding another portion of the chain saw 1 and effect thereof, a gap 17 for removing chippings is formed between the lower end portion of the adjusting unit cover 12 and the chain cover 5, to help the chips existing inside to be discharged, to suppress a decrease in operation function caused by deposition of the chips.

Furthermore, groove portions (concavities and convexities) 10*b* having an antislip function is formed on the peripheral portion of the nut member 10 on both sides of the receiving portion 10*a*. Thus, when the fastening of the guide bar 3 is weak, and the nut member 10 can be rotated with substantially no resistance, the nut member 10 can be immediately rotated by placing the operation lever 13 in the receiving portion 10*a* and then by gripping the groove portions 10*b*.

The entire contents of Japanese Patent Application No. 2013-074904, filed on Mar. 29, 2013, on which priority is claimed, are incorporated herein by reference.

While only a select embodiment has been chosen to illustrate and describe the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and it is not for the purpose of limiting the invention, the invention as claimed in the appended claims and their equivalents.

What is claimed is:

1. A guide bar fastening device for a chain saw, comprising:

a chain cover that covers a part of a chain saw body of the chain saw;

a bolt member that is secured to the chain saw body and configured to penetrate through an end portion of a guide bar and the chain cover;

a circular rotatable nut member provided on the chain cover and configured to fasten the guide bar between the chain saw body and the chain cover by rotating a central screw portion of the nut member on a screw portion of the bolt member, the screw portion protruding toward an outside of the chain cover; and an operation lever that includes:

a first lever that extends in a diametral direction of the nut member, and that has a base end portion that is supported to a peripheral portion of the nut member, so that the first lever is swingable on a plane perpendicular to a rotation plane of the nut member; and a second lever that slidably engages with the first lever in an axial direction of the first lever, wherein the operation lever is movable between a shortened state and a lengthened state by a sliding movement of the second lever relative to the first lever, wherein when the operation lever is in the shortened state, the operation lever is swingingly disposed in a receiving portion of the nut member formed along the diametral direction of the nut member, and when the operation lever is swung out of the receiving portion and the operation lever is lengthened outward to the lengthened state, the operation lever is configured to rotate the nut member via a rotation force acting on an outer end portion of the second lever.

2. The guide bar fastening device for the chain saw according to claim 1, wherein the second lever is engaged with the first lever and covers an outside of the first lever.

3. The guide bar fastening device for the chain saw according to claim 1, wherein the second lever has an outer end portion that is wider than the first lever.

4. The guide bar fastening device for the chain saw according to claim 1, wherein an elastic member that urges the second lever in a direction away from the first lever is disposed between the first lever and the second lever, and when the operation lever is in the shortened state, the operation lever is disposed in the receiving portion of the nut member, and the elastic member urges the second lever in a direction bringing an outer end surface of the second lever into contact with an inner peripheral surface of a member secured on the chain cover.

5. The guide bar fastening device for the chain saw according to claim 1, wherein an engagement unit that releasably engages the second lever to the first lever is disposed between the first lever and the second lever.

6. The guide bar fastening device for the chain saw according to claim 5, wherein the engagement unit comprises:

a claw of an end portion of a stopper arm formed on the first lever; and a lock portion that is engageable with the claw and formed on the second lever.

7. The guide bar fastening device for the chain saw according to claim 1, wherein at least one protrusion is formed on an outer peripheral surface of an end portion of the second lever, and at least one groove, which is engageable with the at least one protrusion, is formed at a periphery of a member secured on the chain cover.

8. The guide bar fastening device for the chain saw according to claim 1, wherein the base end portion of the first lever is supported on the peripheral portion of the nut member via a hinge such that the operation lever is configured to be swingable out of the receiving portion to a maximum opening angle θ defined between the operation lever extending obliquely from a top surface of the nut member away from the chain cover and a plane that extends parallel to the top surface of the nut member.

9. The guide bar fastening device for the chain saw according to claim 1, further comprising:

a torsion coil spring disposed within the operation lever, wherein the operation lever is urged by the torsion coil spring toward the receiving portion.

10. The guide bar fastening device for the chain saw according to claim 1, wherein concavities and convexities are defined on a peripheral portion of the nut member on both sides of the receiving portion.

* * * * *